US010458407B2

(12) United States Patent
Nagaoka et al.

(10) Patent No.: US 10,458,407 B2
(45) Date of Patent: Oct. 29, 2019

(54) SCROLL COMPRESSOR WITH DIFFERENT CHAMFERED CORNERS

(71) Applicant: Mitsubishi Electric Corporation, Tokyo (JP)

(72) Inventors: Fumikazu Nagaoka, Tokyo (JP); Masashi Myogahara, Tokyo (JP); Keisuke Narumi, Tokyo (JP); Yosuke Tsuruoka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 219 days.

(21) Appl. No.: 15/538,460

(22) PCT Filed: Apr. 16, 2015

(86) PCT No.: PCT/JP2015/061753
§ 371 (c)(1),
(2) Date: Jun. 21, 2017

(87) PCT Pub. No.: WO2016/166874
PCT Pub. Date: Oct. 20, 2016

(65) Prior Publication Data

US 2018/0017055 A1 Jan. 18, 2018

(51) Int. Cl.
*F04C 18/02* (2006.01)
*F04C 27/00* (2006.01)

(52) U.S. Cl.
CPC ..... *F04C 18/0284* (2013.01); *F04C 18/0215* (2013.01); *F04C 18/0253* (2013.01);
(Continued)

(58) Field of Classification Search
CPC ..... F04C 18/0284; F04C 18/0215; F04C 18/0253; F04C 27/007; F04C 18/0269; F04C 18/0246
(Continued)

(56) References Cited

U.S. PATENT DOCUMENTS 4,696,084 A * 9/1987 Hirano ..... F01C 1/0246 29/557
5,304,045 A 4/1994 Hoshino et al.
(Continued)

FOREIGN PATENT DOCUMENTS

JP S59-161002 U 5/1986
JP 05187371 A * 7/1993 ..... B23C 5/10
(Continued)

OTHER PUBLICATIONS

English translation of JP-05187371 by J-PiatPat Jul. 31, 2019.*
(Continued)

*Primary Examiner* — Deming Wan
(74) *Attorney, Agent, or Firm* — Posz Law Group, PLC

(57) ABSTRACT

A scroll compressor includes a first chamfered portion formed at a distal end portion of a spiral blade of a fixed scroll, a second chamfered portion formed at a distal end portion of a spiral blade of an orbiting scroll, a third chamfered portion formed at a bottom portion of the spiral blade of the fixed scroll, and a fourth chamfered portion formed at a bottom portion of the spiral blade of the orbiting scroll. An expression of $0<\{(Av\mathbf{1}+Av\mathbf{2})/2\}/Ac<1\times10^{-4}$ is satisfied where a sectional area of a space between the first chamfered portion and the fourth chamfered portion is defined as Av1, a sectional area of a space between the second chamfered portion and the third chamfered portion is defined as Av2, and a sectional area of a compression chamber is defined as Ac.

6 Claims, 8 Drawing Sheets

(52) U.S. Cl.
CPC ..... *F04C 27/007* (2013.01); *F04C 2230/41* (2013.01); *F04C 2230/602* (2013.01); *F05C 2251/10* (2013.01)

(58) Field of Classification Search
USPC ..... 418/55.2
See application file for complete search history.

(56) References Cited

U.S. PATENT DOCUMENTS

| | | | | |
|---|---|---|---|---|
| 5,320,505 | A * | 6/1994 | Misiak | F04C 18/0246 418/55.1 |
| 6,074,185 | A * | 6/2000 | Protos | F04C 18/0284 418/142 |
| 2010/0111739 | A1* | 5/2010 | Murakami | F04C 18/0215 418/55.1 |

FOREIGN PATENT DOCUMENTS

| | | | |
|---|---|---|---|
| JP | H05-187371 | A | 7/1993 |
| JP | 2001-032786 | A | 2/2001 |
| JP | 2001-055989 | A | 2/2001 |
| JP | 2005-083235 | A | 3/2005 |
| JP | 2012-137000 | A | 7/2012 |

OTHER PUBLICATIONS

Office Action dated Feb. 14, 2018 issued in corresponding CN patent application No. 201610149553.2 (and English translation).
International Search Report of the International Searching Authority dated Jul. 14, 2015 for the corresponding international application No. PCT/JP2015/061753 (and English translation).
First Office Action issued by The State Intellectual Property Office of People's Republic of China dated Sep. 29, 2017 in the corresponding Chinese patent application No. 201610149553.2 (English translation attached).

* cited by examiner

ENLARGED VIEW OF PART A

ENLARGED VIEW OF PART C

ENLARGED VIEW OF PART D

SCROLL COMPRESSOR WITH DIFFERENT CHAMFERED CORNERS

This application is a U.S. national stage application of PCT/JP2015/061753 filed on Apr. 16, 2015, the contents of which are incorporated herein by reference.

TECHNICAL FIELD

The present invention relates to a scroll compressor configured to prevent leakage of refrigerant gas that is being compressed from a compression chamber.

BACKGROUND ART

There has been proposed a scroll compressor configured to prevent leakage of refrigerant gas that is being compressed from a compression chamber. For example, there has been proposed a related-art scroll compressor in which a fixed scroll that includes a spiral blade having a spiral shape on a base plate, and an orbiting scroll that includes a spiral blade opposed to the spiral blade of the fixed scroll to be in mesh with the spiral blade of the fixed scroll form a plurality of compression chambers, in which an orbiting motion of the orbiting scroll causes reduction in volume of the compression chamber toward a center of the compression chamber so that compression is performed, in which a chamfered portion is formed at a distal end portion of the spiral blade of the orbiting scroll, and in which a recessed portion is formed at a bottom portion of an outer wall of the spiral blade of the fixed scroll (for example, see Patent Literature 1).

CITATION LIST

Patent Literature

Patent Literature 1: Japanese Unexamined Patent Application Publication No. 2012-137000

SUMMARY OF INVENTION

Technical Problem

In the scroll compressor disclosed in Patent Literature 1, no suitable dimensional relationship is defined between the chamfered portion formed at the distal end portion of the spiral blade of the orbiting scroll and the recessed portion formed at the bottom portion of the outer wall of the spiral blade of the fixed scroll, that is, at a position opposed to the chamfered portion formed at the distal end portion of the spiral blade of the orbiting scroll. Further, in the scroll compressor disclosed in Patent Literature 1, there is no particular definition for a shape of the distal end portion of the spiral blade of the fixed scroll and a shape of the bottom portion of the outer wall of the spiral blade of the orbiting scroll, that is, a shape at a position opposed to the distal end portion of the spiral blade of the fixed scroll. Consequently, the scroll compressor disclosed in Patent Literature 1 has a problem in that a gap formed between the distal end portion of the spiral blade and the bottom portion of the spiral blade is increased to cause an increase in amount of leakage of the refrigerant gas that is being compressed, increasing leakage loss.

The present invention has been made to solve the above-mentioned problem, and has an object to provide a scroll compressor capable of preventing the leakage of the refrigerant that is being compressed through the gap between the distal end portion of the spiral blade and the bottom portion of the spiral blade, thereby being capable of preventing an increase in leakage loss.

Solution to Problem

According to one embodiment of the present invention, there is provided a scroll compressor including a fixed scroll including a first base plate portion and a first spiral blade provided to stand on one surface of the first base plate portion, an orbiting scroll including a second base plate portion and a second spiral blade provided to stand on a surface of the second base plate portion opposite to the fixed scroll, and is configured to perform an orbiting motion with respect to the fixed scroll, the first spiral blade and the second spiral blade being in mesh with each other to form a compression chamber, a first chamfered portion formed at each of both corner portions of a distal end portion of the first spiral blade, a second chamfered portion formed at each of both corner portions of a distal end portion of the second spiral blade, a third chamfered portion formed on each of both sides of a bottom portion of the first spiral blade, the third chamfered portion having a same shape as a shape of the second chamfered portion, and a fourth chamfered portion formed on each of both sides of a bottom portion of the second spiral blade, the fourth chamfered portion having a same shape as a shape of the first chamfered portion, in which an expression of $0<\{(Av\mathbf{1}+Av\mathbf{2})/2\}/Ac<1\times10^{-4}$ is satisfied, under a state in which, among cross sections of the compression chamber passing through an orbiting center of the orbiting scroll and along a standing direction of the first spiral blade and the second spiral blade, a cross section having a largest sectional area is observed, where a sectional area of a space formed between the first chamfered portion and the fourth chamfered portion under a state in which the first chamfered portion and the fourth chamfered portion are closest to each other is defined as Av1, a sectional area of a space formed between the second chamfered portion and the third chamfered portion under a state in which the second chamfered portion and the third chamfered portion are closest to each other is defined as Av2, and a sectional area of the compression chamber is defined as Ac.

Advantageous Effects of Invention

In the scroll compressor of an embodiment of the present invention, the shape of the first chamfered portion formed at the distal end portion of the first spiral blade of the fixed scroll and the shape of the fourth chamfered portion formed at the bottom portion of the second spiral blade of the orbiting scroll, that is, the shape at the position opposed to the first chamfered portion are the same. Further, the shape of the second chamfered portion formed at the distal end portion of the second spiral blade of the orbiting scroll and the shape of the third chamfered portion formed at the bottom portion of the first spiral blade of the fixed scroll, that is, the shape at the position opposed to the second chamfered portion are the same. Further, in the scroll compressor of an embodiment of the present invention, the expression of $0<\{(Av\mathbf{1}+Av\mathbf{2})/2\}/Ac<1\times10^{-4}$ is satisfied, under a state in which, among cross sections of the compression chamber passing through an orbiting center of the orbiting scroll and along a standing direction of the first spiral blade and the second spiral blade, a cross section having a largest sectional area is observed, where a sectional area of a space formed between the first chamfered portion and the fourth chamfered portion under a state in which the first chamfered portion and the fourth chamfered portion are closest to each other is defined as Av1, a sectional area of a space formed between the second chamfered portion and the third chamfered portion under a state in which the second chamfered portion and the third chamfered portion are closest to each other is defined as Av2, and a sectional area of the compression chamber is defined as Ac. Thus, in the scroll compressor of an embodiment of the present invention, the leakage of the refrigerant that is being compressed through the gap between the distal end portion of the spiral blade and the bottom portion of the spiral blade can be prevented. Consequently, the increase in leakage loss can be prevented. Thus, an embodiment of the present invention is capable of achieving a highly efficient scroll compressor.

DESCRIPTION OF EMBODIMENTS

A scroll compressor of Embodiments of the present invention is hereinafter described with reference to the drawings. The scroll compressor of a vertical installation type is described herein as an example. However, the present invention is also applicable to a scroll compressor of a horizontal installation type. Further, the following drawings including FIG. 1 are schematic, and a relationship in sizes of components may be different from the actual relationship.

Embodiment 1

Figure 1:
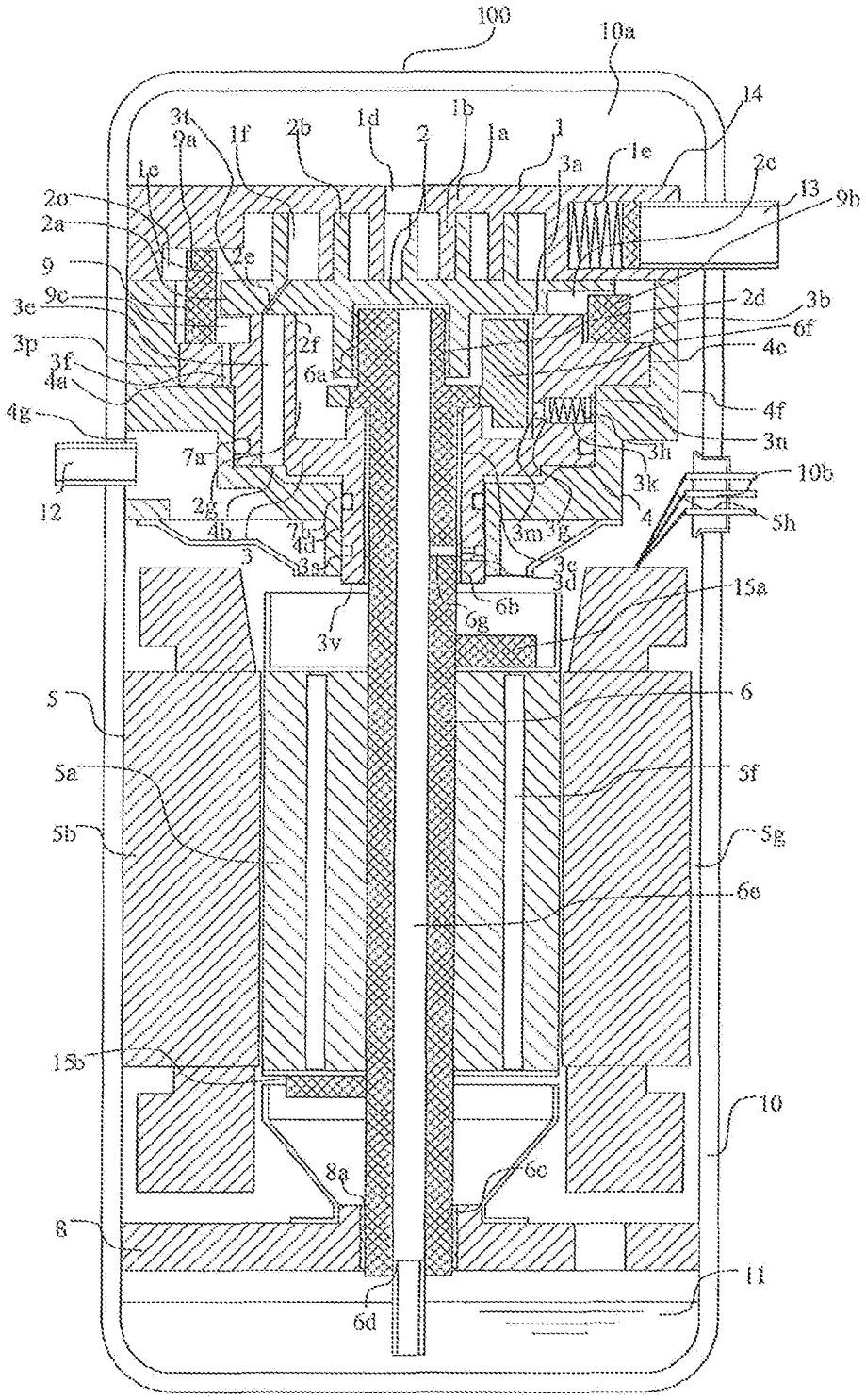
FIG. 1 is a vertical sectional view for illustrating a scroll compressor of Embodiment 1 of the present invention.

FIG. 1 is a vertical sectional view for illustrating a scroll compressor of Embodiment 1 of the present invention.

A scroll compressor 100 is configured to suck refrigerant gas circulating in a refrigeration cycle, compress the sucked refrigerant gas into a high-temperature and high-pressure state, and discharge the compressed refrigerant gas. The scroll compressor 100 includes a compression mechanism 14 constructed of a combination of a fixed scroll 1 and an orbiting scroll 2 configured to revolve (orbit) with respect to the fixed scroll 1. Further, the scroll compressor 100 of Embodiment 1 is a hermetic compressor, and the compression mechanism 14 is arranged in a hermetic container 10. In the hermetic container 10, there is also stored an electric motor 5 configured to drive the orbiting scroll 2 connected to a main shaft 6. In the case of the scroll compressor 100 of the vertical installation type, in the hermetic container 10, for example, the compression mechanism 14 is arranged on an upper side, and the electric motor 5 is arranged on a lower side.

The fixed scroll 1 includes a base plate portion 1*a* and a spiral blade 1*b*. The spiral blade 1*b* is a spiral protrusion provided to stand on one surface (lower side in FIG. 1) of the base plate portion 1*a*. Further, the orbiting scroll 2 includes a base plate portion 2*a* and a spiral blade 2*b*. The spiral blade 2*b* is a spiral protrusion provided to stand on a surface of the base plate portion 2*a* on a side opposed to the fixed scroll 1 (upper side in FIG. 1). The spiral blade 2*b* has substantially the same shape as that of the spiral blade 1*b*. The spiral blade 1*b* of the fixed scroll 1 and the spiral blade 2*b* of the orbiting scroll 2 are brought into mesh with each other so that a compression chamber 1*f* to be relatively changed in volume is geometrically formed.

Herein, the base plate portion 1*a* corresponds to a first base plate portion of the present invention. The spiral blade 1*b* corresponds to a first spiral blade of the present invention. The base plate portion 2*a* corresponds to a second base plate portion of the present invention. The spiral blade 2*b* corresponds to a second spiral blade of the present invention. Further, when a space formed between the spiral blade 1*b* of the fixed scroll 1 and the spiral blade 2*b* of the orbiting scroll 2 communicates with a suction port 1*e*, the refrigerant gas is sucked into the space as described later. Further, when the space communicates with a discharge port 1*d*, the refrigerant gas is discharged from the space. Further, under a state in which the space is prevented from communicating with the suction port 1*e* and the discharge port 1*d*, the refrigerant gas is compressed in the space. In Embodiment 1, a space formed between the spiral blade 1*b* of the fixed scroll 1 and the spiral blade 2*b* of the orbiting scroll 2 in a state in which the space is prevented from communicating with the suction port 1*e* and the discharge port 1*d* is referred to as the compression chamber 1*f*.

An outer peripheral portion of the fixed scroll 1 is fastened to a guide frame 4 by a bolt (not shown). At an outer peripheral portion of the base plate portion 1*a* of the fixed scroll 1, there is provided a suction pipe 13 configured to guide the refrigerant gas through the suction port 1*e* to the compression chamber 1*f* in the space formed between the spiral blade 1*b* of the fixed scroll 1 and the spiral blade 2*b* of the orbiting scroll 2. At a center portion of the base plate portion 1*a* of the fixed scroll 1, there is located the discharge port 1*d* configured to discharge the refrigerant gas compressed to a high pressure. Then, the refrigerant gas compressed to a high pressure is discharged to an upper portion in the hermetic container 10, that is, to a high-pressure space 10*a*. The refrigerant gas discharged to the high-pressure space 10*a*, as described later, passes through a refrigerant flow passage and is discharged through a discharge pipe 12.

With an Oldham mechanism 9 configured to prevent a rotating motion, the orbiting scroll 2 is caused to perform a revolving motion (orbiting motion) with respect to the fixed scroll 1 without performing the rotating motion. A pair of two Oldham guide grooves 1*c* are formed on a substantially straight line at an outer peripheral portion of the base plate portion 1*a* of the fixed scroll 1. A pair of two fixed-side keys 9*a* of the Oldham mechanism 9 are engaged with the Oldham guide grooves 1*c* to be reciprocally slidable. Further, a pair of two Oldham guide grooves 2*c* having a phase difference of 90 degrees with respect to the Oldham guide grooves 1*c* of the fixed scroll 1 are formed on a substantially straight line at an outer peripheral portion of the base plate portion 2*a* of the orbiting scroll 2. A pair of two orbiting-side keys 9*b* of the Oldham mechanism 9 are engaged with the Oldham guide grooves 2*c* to be reciprocally slidable.

With the Oldham mechanism 9 having the configuration described above, the orbiting scroll 2 can perform the orbiting motion (turning motion) without performing rotation. Further, at a center portion of a surface of the orbiting scroll 2 on a side (lower side in FIG. 1) opposite to the surface on which the spiral blade 2*b* is formed, there is formed an orbiting bearing 2*d* having a hollow cylindrical shape. In the orbiting bearing 2*d*, an orbiting shaft portion 6*a* provided at an upper end of the main shaft 6 is inserted to be rotatable. Further, in the surface of the orbiting scroll 2 on the side (lower side in FIG. 1) opposite to the spiral blade 2*b* of the base plate portion 2*a*, there is formed a thrust surface 2*f* that is slidable and in press-contact with a thrust bearing 3*a* of a compliant frame 3. Further, in the base plate portion 2*a* of the orbiting scroll 2, there is formed a gas extraction hole 2*e* that penetrates through the compression chamber 1*f* and the thrust surface 2*f*, and the refrigerant gas that is being compressed is extracted and guided to the thrust surface 2*f*.

To prevent leakage of the refrigerant gas that is being compressed from the compression chamber 1*f*, the spiral blade 1*b* of the fixed scroll 1 and the spiral blade 2*b* of the orbiting scroll 2 in the scroll compressor 100 of Embodiment 1 have the shapes described below.

Figure 2:
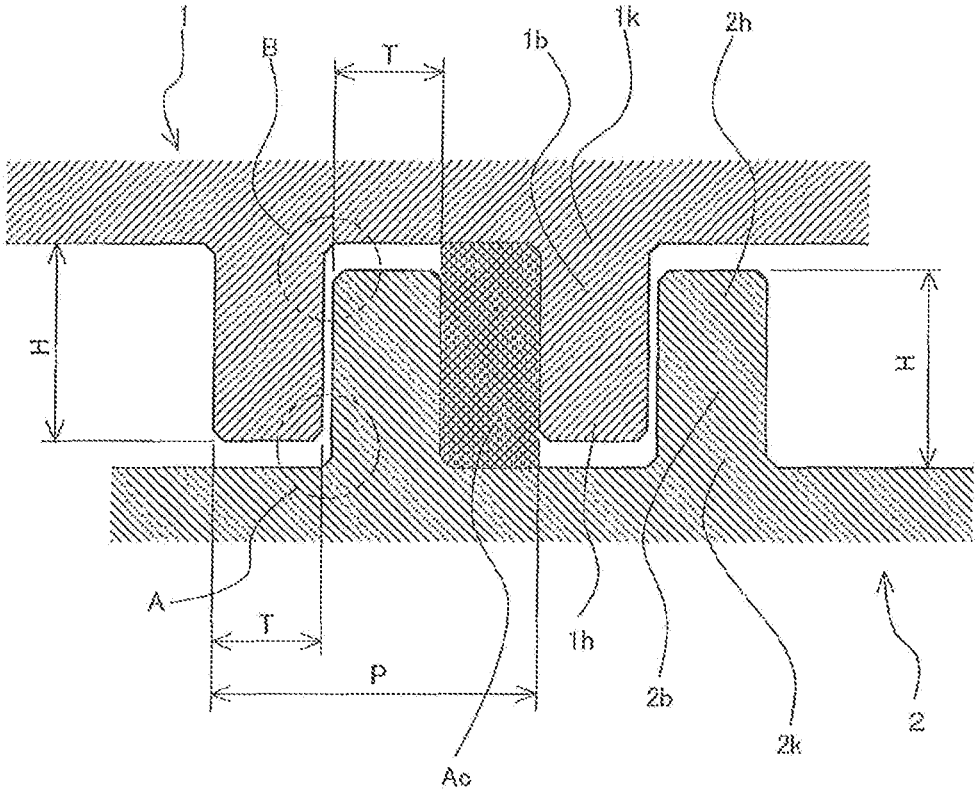
FIG. 2 is a vertical sectional view for illustrating the vicinity of a compression chamber of the scroll compressor of Embodiment 1 of the present invention.
Figure 3:
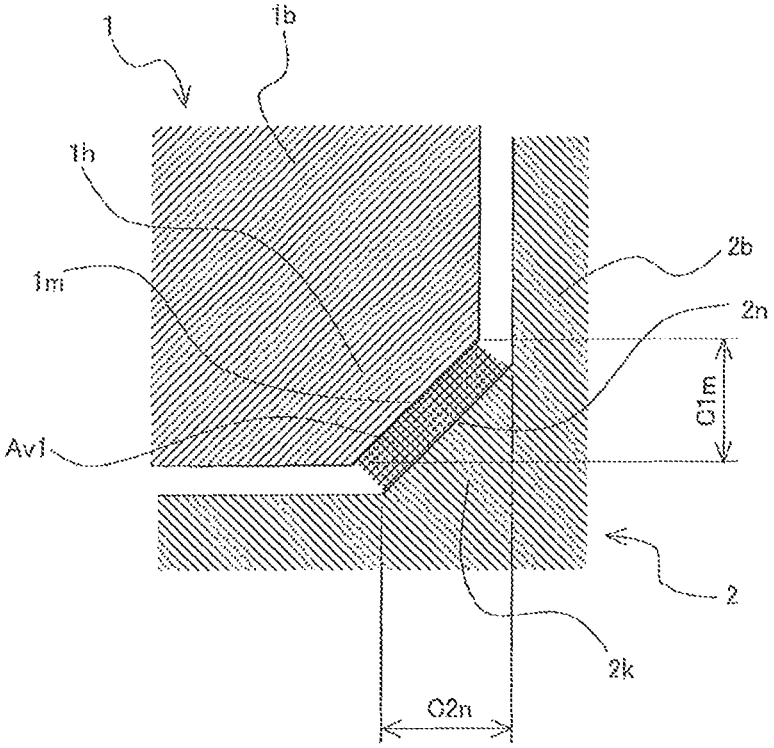
FIG. 3 is an enlarged view of the part A of FIG. 2.
Figure 4:
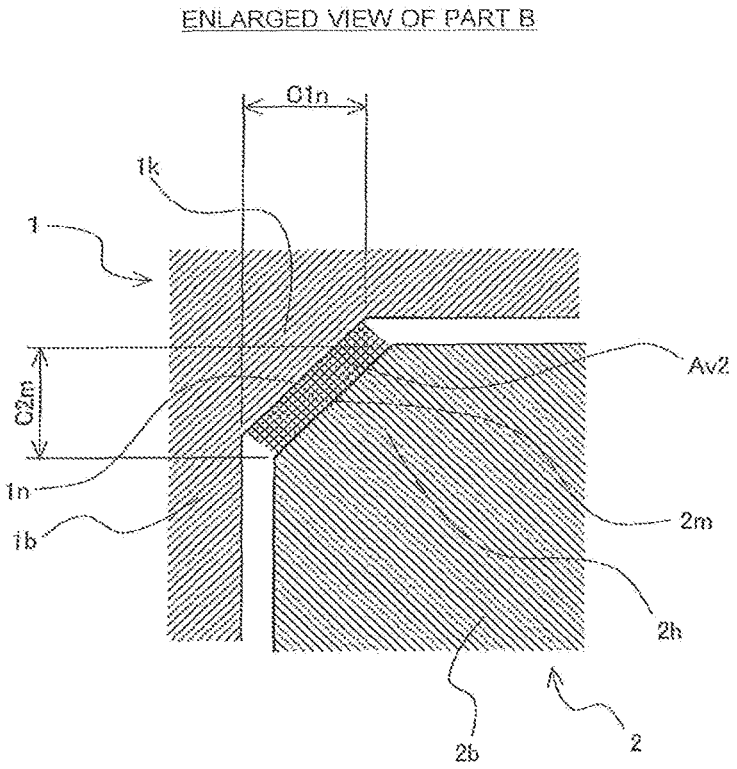
FIG. 4 is an enlarged view of the part B of FIG. 2.

FIG. 2 is a vertical sectional view for illustrating the vicinity of the compression chamber of the scroll compressor of Embodiment 1 of the present invention. FIG. 3 is an enlarged view of the part A of FIG. 2. Further, FIG. 4 is an enlarged view of the part B of FIG. 2. In FIG. 2 to FIG. 4, there is illustrated a cross section that passes through an orbiting center of the orbiting scroll 2, in other words, through an axial center of a main shaft portion 6*b* of the main shaft 6 and is taken along a standing direction of the spiral blade 1*b* of the fixed scroll 1 and the spiral blade 2*b* of the orbiting scroll 2. In the illustrated cross section, the compression chamber 1*f* has the largest sectional area.

At each of both corner portions of a distal end portion 1*h* of the spiral blade 1*b* of the fixed scroll 1, there is formed a chamfered portion 1*m* having a straight chamfer shape in cross section. On each of both sides (outer peripheral side and inner peripheral side) of a bottom portion 2*k* (connection portion between the base plate portion 2*a* and the spiral blade 2*b*) of the spiral blade 2*b* of the orbiting scroll 2, there is formed a chamfered portion 2*n* having the same shape as that of the chamfered portion 1*m*. That is, the chamfered portion 2*n* formed at the bottom portion 2*k* of the spiral blade 2*b* of the orbiting scroll 2 is shaped to be along the chamfered portion 1*m* when the chamfered portion 1*m* formed at the distal end portion 1*h* of the spiral blade 1*b* of the fixed scroll 1 is brought close to the chamfered portion 2*n*.

Further, at each of both corner portions of a distal end portion 2*h* of the spiral blade 2*b* of the orbiting scroll 2, there is formed a chamfered portion 2*m* having a straight chamfer shape in cross section. On each of both sides (outer peripheral side and inner peripheral side) of a bottom portion 1*k* (connection portion between the base plate portion 1*a* and the spiral blade 1*b*) of the spiral blade 1*b* of the fixed scroll 1, there is formed a chamfered portion 1*n* having the same shape as that of the chamfered portion 2*m*. That is, the chamfered portion 1*n* formed at the bottom portion 1*k* of the spiral blade 1*b* of the fixed scroll 1 is shaped to be along the chamfered portion 2*m* when the chamfered portion 2*m* formed at the distal end portion 2*h* of the spiral blade 2*b* of the orbiting scroll 2 is brought close to the chamfered portion 1*n*.

Herein, the chamfered portion 1*m* corresponds to a first chamfered portion of the present invention. The chamfered portion 2*m* corresponds to a second chamfered portion of the present invention. The chamfered portion 1*n* corresponds to a third chamfered portion of the present invention. Further, the chamfered portion 2*n* corresponds to a fourth chamfered portion of the present invention. In Embodiment 1, the chamfered portion 1*m* and the chamfered portion 2*m* are formed to have an equal size (chamfer dimension), and the chamfered portion 1*n* and the chamfered portion 2*n* are formed to have an equal size (chamfer dimension).

Further, in the scroll compressor 100 of Embodiment 1, a space formed between the chamfered portion 1*m* and the chamfered portion 2*n* and a space formed between the chamfered portion 2*m* and the chamfered portion 1*n* are set as described below.

In detail, as illustrated in FIG. 3, a sectional area of the space formed between the chamfered portion 1*m* and the chamfered portion 2*n* under a state in which the chamfered portion 1*m* and the chamfered portion 2*n* are arranged closest to each other is defined as Av1. That is, an area surrounded by the chamfered portion 1*m*, the chamfered portion 2*n*, and imaginary straight lines connecting ends of the chamfered portion 1*m* and ends of the chamfered portion 2*n* is defined as Av1. Further, as illustrated in FIG. 4, a sectional area of the space formed between the chamfered portion 2*m* and the chamfered portion 1*n* under a state in which the chamfered portion 2*m* and the chamfered portion 1*n* are arranged closest to each other is defined as Av2. That is, an area surrounded by the chamfered portion 2*m*, the chamfered portion 1*n*, and imaginary straight lines connecting ends of the chamfered portion 2*m* and ends of the chamfered portion 1*n* is defined as Av2. Further, as illustrated in FIG. 2, a sectional area of the compression chamber 1*f*, that is, the largest sectional area of the compression chamber 1*f* in the cross section that passes through the orbiting center of the orbiting scroll 2 and is taken along the standing direction of the spiral blade 1*b* of the fixed scroll 1 and the spiral blade 2*b* of the orbiting scroll 2 is defined as Ac. When Av1, Av2, and Ac are defined as described above, the scroll compressor 100 of Embodiment 1 is set by the following expression.

$$0<\{(Av1+Av2)/2\}/Ac<1\times10^{-4}$$

As described above, in Embodiment 1, the chamfered portion 1*m* and the chamfered portion 2*m* are formed to have an equal size (chamfer dimension), and the chamfered portion 1*n* and the chamfered portion 2*n* are formed to have an equal size (chamfer dimension). That is, in Embodiment 1, an expression of Av1=Av2=Av is satisfied. Consequently, the above-mentioned expression can also be expressed with the following expression.

$$0<Av/Ac<1\times10^{-4}$$

The sectional area Ac of the compression chamber 1*f* can be calculated with a height H, a pitch P, and a thickness T of the spiral blade 1*b* of the fixed scroll 1 and the spiral blade 2*b* of the orbiting scroll 2 by the following expression.

$$Ac=(P-2\times T)\times H$$

Referring back to FIG. 1, the compliant frame 3 is stored in the guide frame 4. At an outer peripheral portion of the compliant frame 3, there are provided an upper cylindrical surface 3*p* and a lower cylindrical surface 3*s*. At an inner peripheral portion of the guide frame 4, there are provided an upper cylindrical surface 4*c* and a lower cylindrical surface 4*d* into which the upper cylindrical surface 3*p* and the lower cylindrical surface 3*s* of the compliant frame 3 are inserted, respectively. By the insertion of the upper cylindrical surface 3*p* and the lower cylindrical surface 3*s* into the upper cylindrical surface 4*c* and the lower cylindrical surface 4*d*, respectively, the compliant frame 3 is radially supported in the guide frame 4. Further, at a center portion of the lower cylindrical surface 3*s* of the compliant frame 3, there are provided a main bearing 3*c* and an auxiliary main bearing 3*d* that are configured to radially support the main shaft portion 6*b* of the main shaft 6 driven to rotate by a rotor 5*a* of the electric motor 5. Further, in the compliant frame 3, there is formed a communication hole 3*e* that penetrates from a surface of the thrust bearing 3*a* to the outer peripheral portion of the compliant frame 3 in an axial direction. A thrust bearing opening portion 3*t* that is opened at an upper end of the communication hole 3*e* is arranged to face the gas extraction hole 2*e* penetrating through the base plate portion 2*a* of the orbiting scroll 2.

Further, on an outer peripheral side of the thrust bearing 3*a* of the compliant frame 3, there is formed a surface 3*b* (reciprocation slide surface) on which an Oldham mechanism annular portion 9*c* is reciprocally slidable, and a communication hole 3*f* that allows communication between a base plate outer peripheral space 20 and a frame upper space 4*a* is formed to communicate with an inner side of the Oldham mechanism annular portion 9*c*. Further, in the compliant frame 3, there is formed a communication hole 3*m* between the frame upper space 4*a* and a boss portion outer space 2*g*. In the communication hole 3*m*, there is formed an intermediate pressure adjustment valve storage space 3*n* for storing an intermediate pressure adjustment valve 3*g* configured to adjust a pressure in the boss portion outer space 2*g*, an intermediate pressure adjustment valve pressing member 3*h*, and an intermediate pressure adjustment spring 3*k*. The intermediate pressure adjustment spring 3*k* is stored under a state in which the intermediate pressure adjustment spring 3*k* is compressed from its natural length.

In Embodiment 1, the compliant frame 3 and the guide frame 4 are constructed separately from each other. However, the frames are not limited to this configuration, and both frames may be integrally constructed to form a single frame.

A frame lower space 4*b* formed between an inner surface of the guide frame 4 and an outer surface of the compliant frame 3 is partitioned by ring-shaped sealing members 7*a* and 7*b* on upper and lower sides of the frame lower space 4*b*. Herein, ring-shaped sealing grooves configured to store the ring-shaped sealing members 7*a* and 7*b* are formed at two locations in an outer peripheral surface of the compliant frame 3. However, the sealing grooves may be formed in an inner peripheral surface of the guide frame 4. The frame lower space 4*b* communicates only with the communication hole 3*e* of the compliant frame 3, and the refrigerant gas that is being compressed and is fed through the gas extraction hole 2*e* is sealed in the frame lower space 4*b*. Further, a space on an outer peripheral side of the thrust bearing 3*a* that is surrounded by the base plate portion 2*a* of the orbiting scroll 2 and the compliant frame 3 on upper and lower sides, that is, the base plate outer peripheral space 20 is a low-pressure space of a suction gas atmosphere (suction pressure).

An outer peripheral surface of the guide frame 4 is fixed to the hermetic container 10, for example, by shrinkage fitting or by welding. On the guide frame 4 and the fixed scroll 1, that is, on an outer peripheral portion of the compression mechanism 14, there is provided a first passage 4*f* formed by cutting. The refrigerant gas discharged through the discharge port 1*d* to the high-pressure space 10*a* of the hermetic container 10 passes through the first passage 4*f* to flow to a lower side of the hermetic container 10. A bottom portion of the hermetic container 10 serves as a reservoir for storing a refrigerating machine oil 11.

In the hermetic container 10, there is provided the discharge pipe 12 configured to discharge the refrigerant gas to an outside. The above-mentioned first passage 4*f* is provided at a position on a side opposite to the discharge pipe 12. Further, there is provided a first discharge passage 4*g* that communicates from a center at a lower end of the guide frame 4 to a side surface of the guide frame 4, and the first discharge passage 4*g* communicates with the discharge pipe 12.

The electric motor 5 is configured to drive the main shaft 6 to rotate, and is constructed of, for example, the rotor 5*a* fixed to the main shaft portion 6*b* of the main shaft 6 and a stator 5*b* fixed to the hermetic container 10. The rotor 5*a* is fixed to the main shaft portion 6*b* of the main shaft 6 by shrinkage fitting. The rotor 5*a* is driven to rotate by the start of energization to the stator 5*b*, to thereby rotate the main shaft 6. Further, at an upper end of the main shaft 6, there is formed the orbiting shaft portion 6*a* that is rotatably engaged with the orbiting bearing 2*d* of the orbiting scroll 2. A main shaft balance weight 6*f* is fixed to the main shaft 6 on a lower side of the orbiting shaft portion 6*a* by shrinkage fitting.

Further, on the lower side of the orbiting shaft portion 6*a*, there is formed the main shaft portion 6*b* that is rotatably engaged with the main bearing 3*c* and the auxiliary main bearing 3*d* of the compliant frame 3. Further, at a lower end of the main shaft 6, there is formed a sub shaft portion 6*c* that is rotatably engaged with a sub bearing 8*a* of a sub frame 8. In the main shaft 6, there is formed a high-pressure oil feeding hole 6*e* that is formed of a hole penetrating through the main shaft 6 in the axial direction. Thus, the refrigerating machine oil 11 is sucked through an oil feeding port 6*d* of the high-pressure oil feeding hole 6*e* by an oil feeding mechanism or a pump mechanism arranged at a lower portion of the main shaft 6. An upper end of the high-pressure oil feeding hole 6*e* is opened to the orbiting bearing 2*d* of the orbiting scroll 2, and the sucked refrigerating machine oil 11 flows out through an upper end opening of the high-pressure oil feeding hole 6*e* to the orbiting bearing 2*d* so that the orbiting shaft portion 6*a* and the orbiting bearing 2*d* are lubricated. Further, an oil feeding hole 6*g* that branches off in a horizontal direction is formed in the high-pressure oil feeding hole 6*e*. The refrigerating machine oil 11 is fed through the oil feeding hole 6*g* to the auxiliary main bearing 3*d*, to thereby lubricate the main bearing 3*c*, the auxiliary main bearing 3*d*, and the main shaft portion 6*b*.

A first balance weight 15*a* is fixed to an upper end surface of the rotor 5*a*, and a second balance weight 15*b* is fixed to a lower end surface of the rotor 5*a*. The first balance weight 15*a* and the second balance weight 15*b* are located at eccentric positions that are diagonally arranged to each other. Further, in a space outside the orbiting bearing 2*d*, the above-mentioned main shaft balance weight 6*f* is fixed to the main shaft 6 on the lower side of the orbiting shaft portion 6*a*. The three balance weights 15*a*, 15*b*, and 6*f* cancel out imbalance in centrifugal forces and moment forces that are generated by the orbiting motion of the orbiting scroll 2 through intermediation of the orbiting shaft portion 6*a* of the main shaft 6, thereby achieving static balance and dynamic balance.

In the rotor 5*a*, there are provided a plurality of penetrating flow passages 5*f* each penetrating in the axial direction. Further, the penetrating flow passages 5*f* are provided to avoid installation positions of the first balance weight 15*a* and the second balance weight 15*b*. The penetrating flow passages 5*f* may be formed to penetrate through the first balance weight 15*a* and the second balance weight 15*b*.

An outer peripheral surface of the stator 5*b* of the electric motor 5 is fixed to the hermetic container 10 by, for example, shrinkage fitting or welding. In the outer peripheral portion of the stator 5*b*, there is provided a second passage 5*g* formed by cutting. The first passage 4*f* and the second passage 5*g* described above construct a refrigerant flow passage for guiding the refrigerant gas discharged through the discharge port 1*d* to the bottom portion of the hermetic container 10.

Further, as illustrated in FIG. 1, glass terminals 10*b* are disposed on a side surface of the hermetic container 10. The glass terminals 10*b* and the stator 5*b* of the electric motor 5 are connected to each other by lead lines 5*h*.

Next, an operation of the scroll compressor 100 of Embodiment 1 is described.

At the time of activation and operation of the scroll compressor 100, the refrigerant gas is sucked through the suction pipe 13 and the suction port 1*e* to enter the space formed between the spiral blade 1*b* of the fixed scroll 1 and the spiral blade 2*b* of the orbiting scroll 2. When the orbiting scroll 2 driven by the electric motor 5 performs an eccentric turning motion (orbiting motion), the space formed between the spiral blade 1*b* of the fixed scroll 1 and the spiral blade 2*b* of the orbiting scroll 2 is prevented from communicating with the suction port 1*e* and forms the compression chamber 1*f*. The compression chamber 1*f* is reduced in volume as the orbiting scroll 2 performs the eccentric turning motion. The compression stroke causes the refrigerant gas in the compression chamber 1*f* to have a high pressure. In the above-mentioned compression stroke, the refrigerant gas that is being compressed and having an intermediate pressure is guided to the frame lower space 4*b* from the gas extraction hole 2*e* of the orbiting scroll 2 through the communication hole 3*e* of the compliant frame 3, thereby maintaining the intermediate pressure atmosphere in the frame lower space 4*b*.

When the compression chamber 1*f* communicates with the discharge port 1*d* of the fixed scroll 1, the refrigerant gas caused to have a high pressure through the above-mentioned compression stroke is discharged through the discharge port 1*d* to the high-pressure space 10*a* of the hermetic container 10. At this time, the refrigerant gas is mixed with the refrigerating machine oil 11 having lubricated the sliding surface of the compression mechanism 14, and then is discharged as mixture gas from the discharge port 1*d*. The mixture gas passes through the first passage 4*f* provided in the outer peripheral portion of the compression mechanism 14 and the second passage 5*g* provided in the outer peripheral portion of the stator 5*b* of the electric motor 5, and is guided to the space below the electric motor 5, that is, to the bottom portion of the hermetic container 10. The mixture gas is separated in the course of being guided to the bottom portion of the hermetic container 10. The refrigerant gas separated from the refrigerating machine oil 11 flows into the penetrating flow passage 5*f* provided in the rotor 5*a*, passes through the first discharge passage 4*g*, and further passes through the discharge pipe 12 to be discharged to an outside of the hermetic container 10.

As the scroll compressor 100 operates, that is, as the main shaft 6 rotates, the refrigerating machine oil 11 in the bottom portion of the hermetic container 10 flows through the oil feeding port 6*d* into the high-pressure oil feeding hole 6*e*, and then flows upward in the high-pressure oil feeding hole 6*e*. A part of the refrigerating machine oil 11 that flows through the high-pressure oil feeding hole 6*e* is guided from an opening at an upper end to a space formed between an upper surface of the orbiting shaft portion 6*a* and the orbiting bearing 2*d*. Then, the refrigerating machine oil 11 is reduced in pressure in the gap that is narrowest in this oil feeding passage, between the orbiting shaft portion 6*a* and the orbiting bearing 2*d*, to have an intermediate pressure higher than a suction pressure and equal to or less than a discharge pressure, and flows to the boss portion outer space 2*g*. Meanwhile, another part of the refrigerating machine oil 11 that flows through the high-pressure oil feeding hole 6*e* is guided from the oil feeding hole 6*g* to a high-pressure-side end surface (lower end surface in FIG. 1) of the main bearing 3*c*. Then, the refrigerating machine oil 11 is reduced in pressure in a space that is narrowest in this oil feeding passage, between the main bearing 3*c* and the main shaft portion 6*b*, to have an intermediate pressure, and similarly flows to the boss portion outer space 2*g*. When the refrigerating machine oil 11 having the intermediate pressure in the boss portion outer space 2*g* (foaming of refrigerant dissolved in the refrigerating machine oil 11 generally causes the refrigerating machine oil 11 to form a two-phase flow of refrigerant gas and refrigerating machine oil) passes through the communication hole 3*m* and the intermediate pressure adjustment valve storage space 3*n*, the refrigerating machine oil 11 overcomes a force exerted by an intermediate pressure adjustment spring 3*k*, pushes up the intermediate pressure adjustment valve 3*g*, and flows to the frame upper space 4*a*. Subsequently, the refrigerating machine oil 11 is discharged through the communication hole 3*f* into the Oldham mechanism annular portion 9*c*.

Also after the refrigerating machine oil 11 is fed to a sliding portion between the thrust surface 2*f* of the orbiting scroll 2 and a sliding portion of the thrust bearing 3*a* of the compliant frame 3, the refrigerating machine oil 11 is discharged into the Oldham mechanism annular portion 9*c*. Then, the refrigerating machine oil 11 discharged through the above-mentioned configuration is fed to a sliding surface and a key sliding surface of the Oldham mechanism annular portion 9*c*, and then is released to the base plate outer peripheral space 20.

As described above, an intermediate pressure Pm1 in the boss portion outer space 2*g* is controlled by a predetermined pressure α that is approximately determined on the basis of a spring force of the intermediate pressure adjustment spring 3*k* and an intermediate pressure exposure area of the intermediate pressure adjustment valve 3*g*, in accordance with the following expression.

$$Pm1=Ps+\alpha$$

(Ps is a suction atmosphere pressure, that is, a low pressure)

Further, in FIG. 1, a lower opening portion of the gas extraction hole 2*e* formed in the base plate portion 2*a* of the orbiting scroll 2 regularly or intermittently communicates with the thrust bearing opening portion 3*t*, that is, an upper opening portion (opening portion on an upper side in FIG. 1) of the communication hole 3*e* formed in the compliant frame 3. Thus, the refrigerant gas that is being compressed and discharged from the compression chamber 1*f* formed between the fixed scroll 1 and the orbiting scroll 2, that is, the refrigerant gas having the intermediate pressure higher than the suction pressure and equal to or less than the discharge pressure is guided to the frame lower space 4*b* through the gas extraction hole 2*e* of the orbiting scroll 2 and the communication hole 3*e* of the compliant frame 3. However, even though the refrigerant gas is guided, the frame lower space 4*b* is a closed space that is sealed by the ring-shaped sealing member 7*a* and the ring-shaped sealing member 7*b*, and hence, during a normal operation, the refrigerant gas has a slight flow in both directions between the compression chamber 1*f* and the frame lower space 4*b* in response to the pressure fluctuation in the compression chamber 1*f*, that is, a state of breathing is provided. As described above, an intermediate pressure Pm2 of the frame lower space 4*b* is controlled by a predetermined magnification β approximately determined by a position of the compression chamber 1*f* communicated with the frame lower space 4*b*, in accordance with the following expression.

$$Pm2=Ps\times\beta$$

(Ps is a suction atmosphere pressure, that is, a low pressure)

With the above-mentioned configuration, that is, with the two intermediate pressures Pm1 and Pm2 and the pressure in the high-pressure space 10*a* applied to the lower end surface 3*v* of the compliant frame 3, the compliant frame 3 is guided by the guide frame 4 to move toward the fixed scroll 1 side (upper side in FIG. 1). Thus, the orbiting scroll 2 being pressed by the compliant frame 3 through the thrust bearing 3*a* also moves upward. As a result, the distal end portion 2*h* of the spiral blade 2*b* of the orbiting scroll 2 slides in contact with the base plate portion 1*a* of the fixed scroll 1, and the distal end portion 1*h* of the spiral blade 1*b* of the fixed scroll 1 slides in contact with the base plate portion 2*a* of the orbiting scroll 2, to thereby compress the refrigerant gas.

Herein, the related-art scroll compressor has a problem in that, during the above-mentioned compression stroke, a gap formed between the distal end portion of the spiral blade and the bottom portion of the spiral blade is increased to cause an increase in amount of leakage of the refrigerant gas that is being compressed, increasing leakage loss. However, in the scroll compressor 100 of Embodiment 1, the chamfered portion 1*m* is formed at the distal end portion 1*h* of the spiral blade 1*b* of the fixed scroll 1, and the chamfered portion 2*n* having the same shape as that of the chamfered portion 1*m* is formed at the bottom portion 2*k* of the spiral blade 2*b* of the orbiting scroll 2. Further, the chamfered portion 2*m* is formed at the distal end portion 2*h* of the spiral blade 2*b* of the orbiting scroll 2, and the chamfered portion 1*n* having the same shape as that of the chamfered portion 2*m* is formed at the bottom portion 1*k* of the spiral blade 1*b* of the fixed scroll 1. Further, the configuration satisfying the expression of $0<Av/Ac<1\times10^{-4}$ is achieved. Consequently, the scroll compressor 100 of Embodiment 1 is capable of preventing the leakage of the refrigerant gas that is being compressed from the gap between the distal end portion of the spiral blade and the bottom portion of the spiral blade, thereby being capable of preventing an increase in leakage loss. Thus, the scroll compressor 100 of Embodiment 1 is capable of achieving a highly efficient scroll compressor.

Figure 5:
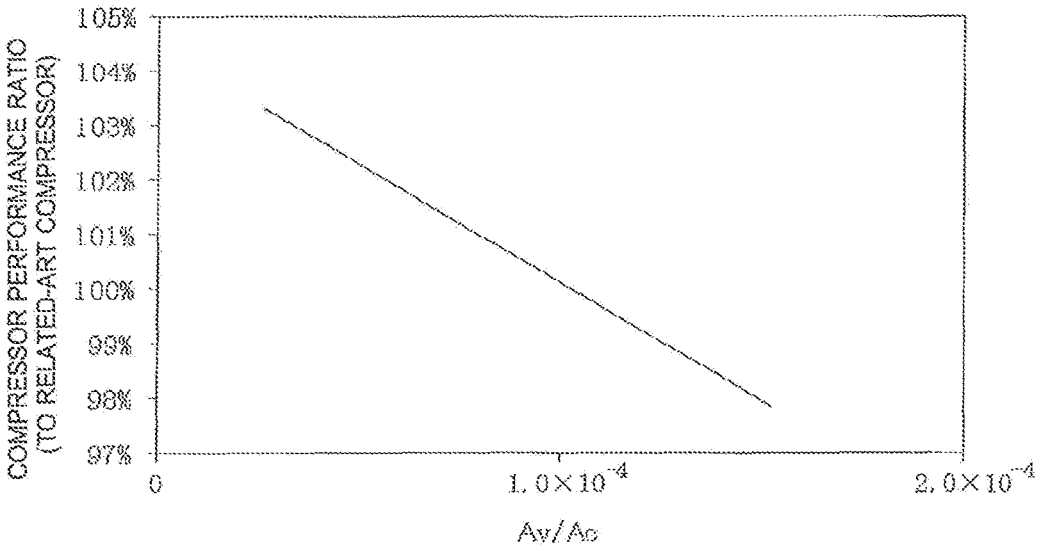
FIG. 5 is a graph for showing a relationship between Av/Ac and a compressor performance in the scroll compressor of Embodiment 1 of the present invention.

FIG. 5 is a graph for showing a relationship between Av/Ac and a compressor performance in the scroll compressor of Embodiment 1 of the present invention. In FIG. 5, the performance of the scroll compressor 100 of Embodiment 1 is indicated by a compressor performance ratio. The compressor performance ratio indicates a ratio of the performance of the scroll compressor 100 of Embodiment 1 to the performance of the related-art scroll compressor. The compressor performance ratio exceeding 100% indicates that the performance of the scroll compressor 100 of Embodiment 1 exceeds the performance of the related-art scroll compressor.

Further, the term "performance" as used herein corresponds to a coefficient of performance (COP). The coefficient of performance (COP) can be calculated with the following expression.

$$COP=\text{Refrigeration capacity}/\text{Consumed power}$$

That is, under a state in which the scroll compressor 100 is mounted as a compressor for a refrigeration cycle circuit, and the refrigeration cycle circuit is operated with a predetermined refrigeration capacity, the performance of the scroll compressor 100 of Embodiment 1 is calculated by dividing the refrigeration capacity by consumed power of the scroll compressor 100. Under a state in which the related-art scroll compressor is mounted to the refrigeration cycle circuit used for the calculation of the performance of the scroll compressor 100 of Embodiment 1, and the refrigeration cycle circuit is operated with the predetermined refrigeration capacity, the performance of the related-art scroll compressor is calculated by dividing the refrigeration capacity by the consumed power of the scroll compressor.

Figure 6:
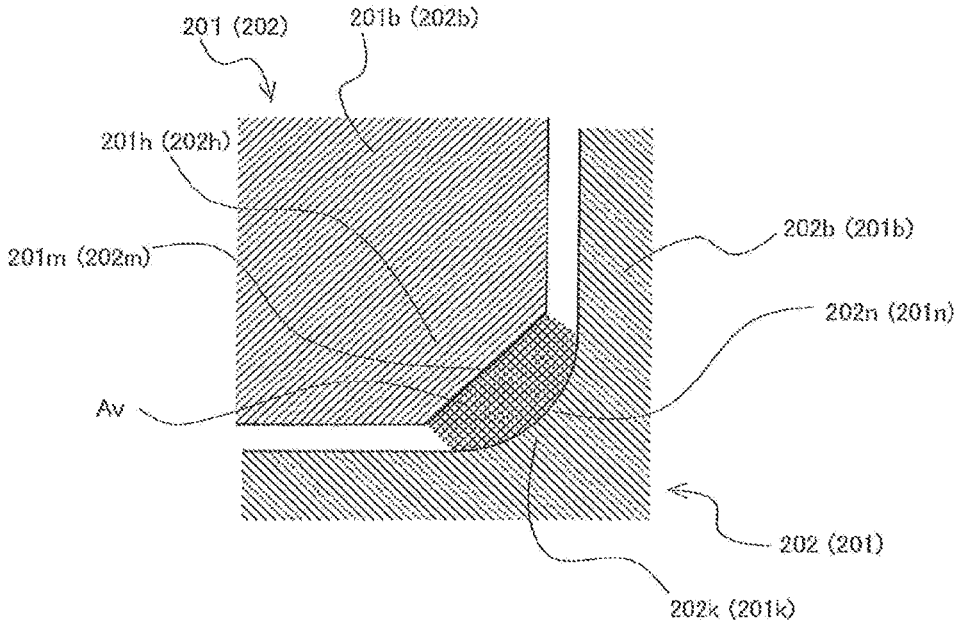
FIG. 6 is an enlarged view for illustrating shapes of relevant parts of the spiral blades in a related-art scroll compressor that is used for calculation of a compressor performance ratio in FIG. 5.

In the related-art scroll compressor used for the calculation of the compressor performance ratio in FIG. 5, spiral blades of a fixed scroll and an orbiting scroll are formed as illustrated in FIG. 6. That is, at each of both corner portions of a distal end portion 201*h* of a spiral blade 201*b* of a fixed scroll 201, there is formed a chamfered portion 201*m* having a straight chamfer shape in cross section. On each of both sides of a bottom portion 202*k* of a spiral blade 202*b* of an orbiting scroll 202, there is formed a chamfered portion 202*n* having an arcuate chamfer shape in cross section. Similarly, at each of both corner portions of a distal end portion 202*h* of the spiral blade 202*b* of the orbiting scroll 202, there is formed a chamfered portion 202*m* having a straight chamfer shape in cross section. On each of both sides of a bottom portion 201*k* of the spiral blade 201*b* of the fixed scroll 201, there is formed a chamfered portion 201*n* having an arcuate chamfer shape in cross section. The related-art scroll compressor satisfies an expression of $Av/Ac=1\times10^{-4}$.

As illustrated in FIG. 6, in the related-art scroll compressor, the chamfer shape of the distal end portion of the spiral blade is straight in cross section, and the chamfer shape of the bottom portion of the spiral blade is arcuate in cross section. Thus, in the related-art scroll compressor, a sectional area Av of a space formed between the distal end portion and the bottom portion of the spiral blades cannot be reduced, and hence there is difficulty in setting Av/Ac to be less than $1\times10^{-4}$. Meanwhile, in the scroll compressor 100 of Embodiment 1, the chamfered portion 1*m* is formed at the distal end portion 1*h* of the spiral blade 1*b* of the fixed scroll 1, and the chamfered portions 2*n* having the same shape as that of the chamfered portion 1*m* is formed at the bottom portion 2*k* of the spiral blade 2*b* of the orbiting scroll 2. Further, the chamfered portion 2*m* is formed at the distal end portion 2*h* of the spiral blade 2*b* of the orbiting scroll 2, and the chamfered portion 1*n* having the same shape as that of the chamfered portion 2*m* is formed at the bottom portion 1*k* of the spiral blade 1*b* of the fixed scroll 1. Thus, in the scroll compressor 100 of Embodiment 1, a sectional area Av of a space formed between the distal end portion and the bottom portion of the spiral blades can be set less than that of the related-art scroll compressor. Thus, the configuration satisfying the expression of $Av/Ac<1\times10^{-4}$ can be achieved. Thus, as illustrated in FIG. 5, the scroll compressor 100 of Embodiment 1 is capable of preventing leakage of the refrigerant gas that is being compressed from the gap between the distal end portion of the spiral blade and the bottom portion of the spiral blade, thereby being capable of preventing the increase in leakage loss. That is, the scroll compressor 100 of Embodiment 1 is capable of achieving a highly efficient scroll compressor.

At the end of Embodiment 1, additional remarks are made on that the configuration of the scroll compressor 100 of Embodiment 1 may achieve further improvement in effect of preventing the increase in leakage loss through employment of a scroll compressor including the compression chamber 1*f* having a small volume.

Figure 7:
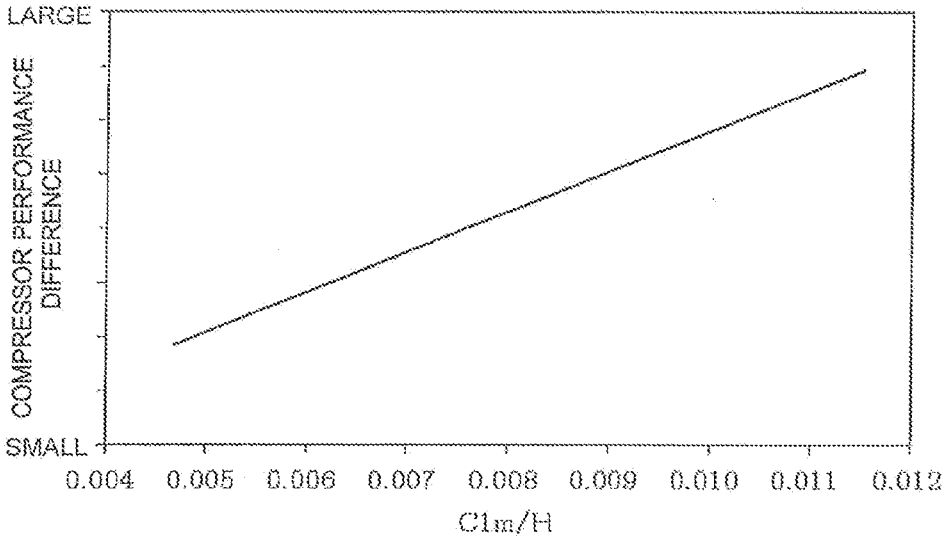
FIG. 7 is a graph for showing a relationship between C1*m*/H and a compressor performance in the scroll compressor of Embodiment 1 of the present invention.

FIG. 7 is a graph for showing a relationship between C1*m*/H and a compressor performance in the scroll compressor of Embodiment 1 of the present invention. The C1*m* corresponds to a chamfer dimension C1*m* (see FIG. 3) of the chamfered portion 1*m* formed at the distal end portion 1*h* of the spiral blade 1*b* of the fixed scroll 1. In Embodiment 1, the chamfered portion 1*m* and the chamfered portion 2*m* have an equal size (chamfer dimension), and hence an expression of C1*m*=C2*m* is satisfied. The C2*m* corresponds to a chamfer dimension C2*m* (see FIG. 4) of the chamfered portion 2*m* formed at the distal end portion 1*h* of the spiral blade 2*b* of the orbiting scroll 2.

Figure 8:
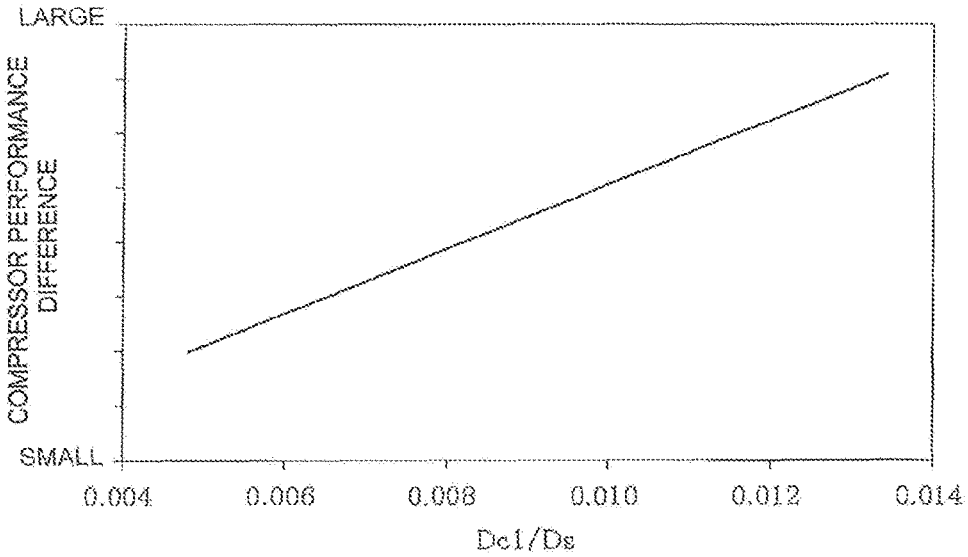
FIG. 8 is a graph for showing a relationship between Dc1/Ds and the compressor performance in the scroll compressor of Embodiment 1 of the present invention.

FIG. 8 is a graph for showing a relationship between Dc1/Ds and a compressor performance in the scroll compressor of Embodiment 1 of the present invention. The Dc1 represents an equivalent hydraulic diameter of the sectional area Av1 of the space formed between the chamfered portion 1*m* and the chamfered portion 2*n*. Further, the Ds represents an equivalent hydraulic diameter of the sectional area Ac of the compression chamber 1*f*. As described above, in Embodiment 1, the chamfered portion 1*m* and the chamfered portion 2*m* are formed to have an equal size (chamfer dimension), and the chamfered portion 1*n* and the chamfered portion 2*n* are formed to have an equal size (chamfer dimension). Thus, the equivalent hydraulic diameter Dc2 of the sectional area Av2 of the space formed between the chamfered portion 2*m* and the chamfered portion 1*n* satisfies an expression of Dc2=Dc1.

The equivalent hydraulic diameter D can be calculated with the following expression.

$$D=4\times(\text{Flow passage sectional area})/(\text{Peripheral length of flow passage cross section})$$

Thus, the equivalent hydraulic diameter Ds of the sectional area Ac of the compression chamber 1*f* can be calculated with the following expression.

$$Ds=4\times Ac/\{2\times(P-2\times T)+2\times H)$$

Further, the equivalent hydraulic diameter Dc1 of the sectional area Av1 of the space formed between the chamfered portion 1*m* and the chamfered portion 2*n* can be calculated with the following expression.

$$Dc1=4\times Av1/(\text{a sum of lengths of the chamfered portion } 1m\text{, the chamfered portion } 2n\text{, and the imaginary straight lines connecting the ends of the chamfered portion } 1m \text{ to the ends of the chamfered portion } 2n)$$

In FIG. 7 and FIG. 8, the performance of the scroll compressor 100 of Embodiment 1 is shown as a compressor performance difference. The compressor performance difference is calculated by subtracting the performance of the related-art scroll compressor from the performance of the scroll compressor 100 of Embodiment 1.

In FIG. 7, under a state in which the chamfer dimension C1*m* of the chamfered portion 1*m* formed in the distal end portion 1*h* of the spiral blade 1*b* of the fixed scroll 1 is fixed, as a height H of the spiral blade 1*b* of the fixed scroll 1 is reduced, a value of C1*m*/H increases. That is, in FIG. 7, the volume of the compression chamber 1*f* is smaller on the right side. Further, in FIG. 8, under a state in which the equivalent hydraulic diameter Dc1 of the sectional area Av1 of the space formed between the chamfered portion 1*m* and the chamfered portion 2*n* is fixed, as the equivalent hydraulic diameter Ds of the sectional area Ac of the compression chamber 1*f* is reduced, a value of Dc1/Ds increases. That is, also in FIG. 8, the volume of the compression chamber 1*f* is smaller on the right side, as in FIG. 7.

When the sectional area Av of the space formed between the distal end portion and the bottom portion of the spiral blades is the same, the amount of refrigerant gas that leaks from the gap between the distal end portion and the bottom portion of the spiral blades in the scroll compressor having a small volume of the compression chamber is substantially equal to that of the scroll compressor having a large volume of the compression chamber. That is, when the sectional area Av of the space formed between the distal end portion and the bottom portion of the spiral blades is the same, the amount of leakage of refrigerant gas with respect to the amount of refrigerant gas in the compression chamber in the scroll compressor having the small volume of the compression chamber is larger than that of the scroll compressor having the large volume of the compression chamber. That is, when the sectional area Av of the space formed between the distal end portion and the bottom portion of the spiral blades is the same, leakage loss in the scroll compressor having a small volume of the compression chamber is larger than that of the scroll compressor having a large volume of the compression chamber. Consequently, the efficiency is degraded.

In other words, in the scroll compressor having a small volume of the compression chamber, to achieve the leakage loss equal to that of the scroll compressor having a large volume of the compression chamber, it is necessary to reduce the sectional area Av of the space formed between the distal end portion and the bottom portion of the spiral blades depending on the amount of reduction in volume of the compression chamber. However, as illustrated in FIG. 6, in the related-art scroll compressor, there is difficulty in setting the sectional area Av of the space formed between the distal end portion and the bottom portion of the spiral blades to be less than a certain value. Consequently, in the related-art scroll compressor, when the volume of the compression chamber is smaller than the certain value, the leakage loss increases depending on the amount of reduction in volume of the compression chamber, degrading the efficiency.

Meanwhile, in the scroll compressor 100 of Embodiment 1, as described above, the sectional area Av of the space formed between the distal end portion and the bottom portion of the spiral blades can be set smaller than that of the related-art scroll compressor. Consequently, with the scroll compressor 100 of Embodiment 1, even when the compression chamber has such a volume that the increase in leakage loss cannot be prevented by the related-art scroll compressor, the sectional area Av of the space formed between the distal end portion and the bottom portion of the spiral blades can be reduced depending on the amount of reduction in volume of the compression chamber. That is, with the scroll compressor 100 of Embodiment 1, even when the compression chamber has such a volume that the increase in leakage loss cannot be prevented by the related-art scroll compressor, the increase in leakage loss can be prevented. Consequently, a highly efficient scroll compressor can be achieved. As illustrated in FIG. 7 and FIG. 8, the effect can be improved as the volume of the compression chamber is smaller.

Embodiment 2

In Embodiment 1, each of the chamfered portion 1*m*, the chamfered portion 1*n*, the chamfered portion 2*m*, and the chamfered portion 2*n* has a straight chamfer shape in cross section. However, the chamfer shape of the chamfered portion 1*m*, the chamfered portion 1*n*, the chamfered portion 2*m*, and the chamfered portion 2*n* is not limited to the straight chamfer shape. As long as the chamfered portion 1*m* and the chamfered portion 2*n* have the same shape, and the chamfered portion 2*m* and the chamfered portion 1*n* have the same shape, the effect described in Embodiment 1 can be achieved. The chamfered portion 1*m*, the chamfered portion 1*n*, the chamfered portion 2*m*, and the chamfered portion 2*n* may have, for example, a chamfer shape described below. In Embodiment 2, matters that are not particularly described are the same as those of Embodiment 1, and the same function and configuration are described with the same reference signs.

Figure 9:
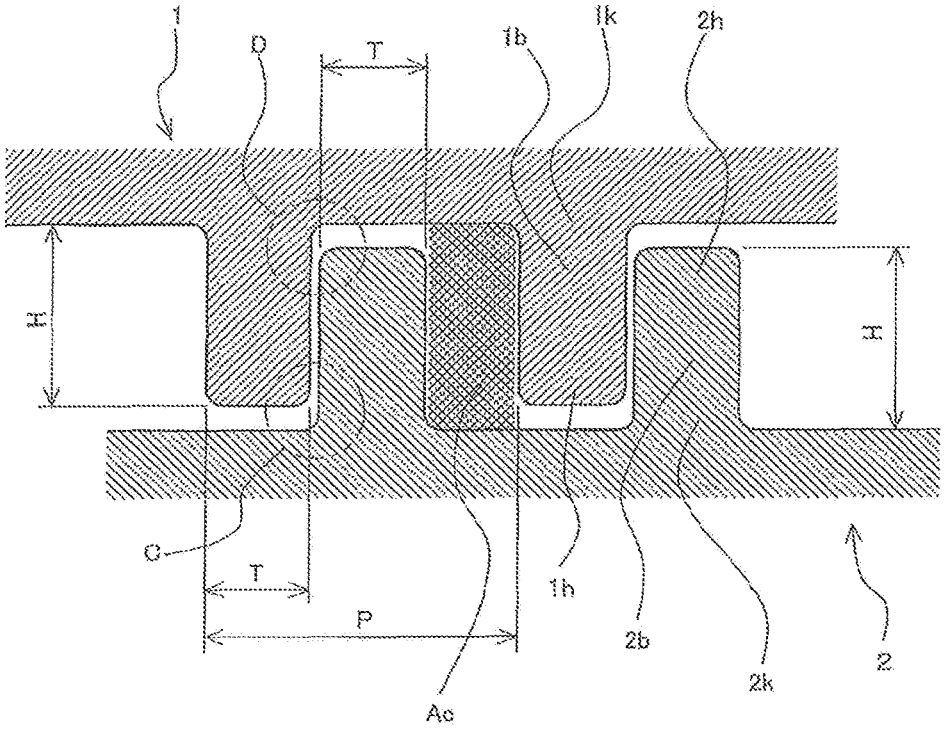
FIG. 9 is a vertical sectional view for illustrating the vicinity of a compression chamber of a scroll compressor of Embodiment 2 of the present invention.
Figure 10:
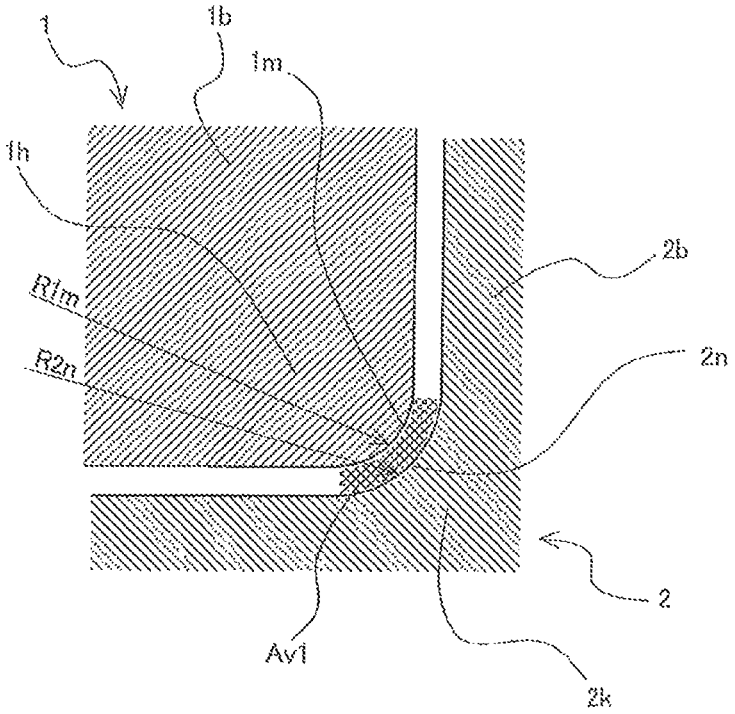
FIG. 10 is an enlarged view of the part C of FIG. 9.
Figure 11:
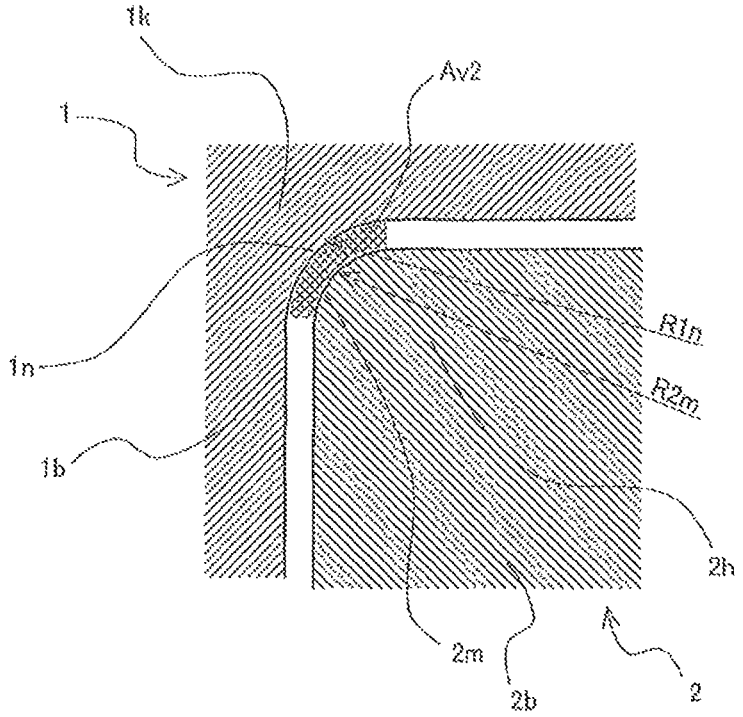
FIG. 11 is an enlarged view of the part D of FIG. 9.

FIG. 9 is a vertical sectional view for illustrating the vicinity of a compression chamber of a scroll compressor of Embodiment 2 of the present invention. FIG. 10 is an enlarged view of the part C of FIG. 9. Further, FIG. 11 is an enlarged view of the part D of FIG. 9. In FIG. 9 to FIG. 11, there is illustrated the cross section that passes through the orbiting center of the orbiting scroll 2, in other words, through the axial center of a main shaft portion 6*b* of the main shaft 6 and is taken along the standing direction of the spiral blade 1*b* of the fixed scroll 1 and the spiral blade 2*b* of the orbiting scroll 2. In the illustrated cross section, the compression chamber 1*f* has the largest sectional area.

At each of both the corner portions of the distal end portion 1*h* of the spiral blade 1*b* of the fixed scroll 1, there is formed the chamfered portion 1*m* having an arcuate chamfer shape in cross section, specifically, having an arcuate central portion protruding toward the orbiting scroll 2 side. On each of both sides of the bottom portion 2*k* of the spiral blade 2*b* of the orbiting scroll 2, there is formed the chamfered portion 2*n* having the same shape as that of the chamfered portion 1*m*, specifically, having an arcuate central portion recessing toward an opposite side to the fixed scroll 1. That is, the chamfered portion 2*n* formed at the bottom portion 2*k* of the spiral blade 2*b* of the orbiting scroll 2 is shaped to be along the chamfered portion 1*m* when the chamfered portion 1*m* formed at the distal end portion 1*h* of the spiral blade 1*b* of the fixed scroll 1 is brought close to the chamfered portion 2*n*.

Further, at each of both the corner portions of the distal end portion 2*h* of the spiral blade 2*b* of the orbiting scroll 2, there is formed the chamfered portion 2*m* having an arcuate chamfer shape in cross section, specifically, an arcuate central portion protruding toward the fixed scroll 1 side. On each of both the sides of the bottom portion 1*k* of the spiral blade 1*b* of the fixed scroll 1, there is formed the chamfered portion 1*n* having the same shape as that of the chamfered portion 2*m*, specifically, having an arcuate central portion recessing toward an opposite side toward the orbiting scroll 2 side. That is, the chamfered portion 1*n* formed at the bottom portion 1*k* of the spiral blade 1*b* of the fixed scroll 1 is shaped to be along the chamfered portion 2*m* when the chamfered portion 2*m* formed at the distal end portion 2*h* of the spiral blade 2*b* of the orbiting scroll 2 is brought close to the chamfered portion 1*n*.

Further, similarly to Embodiment 1, in the scroll compressor 100 of Embodiment 2, the space formed between the chamfered portion 1*m* and the chamfered portion 2*n* and the space formed between the chamfered portion 2*m* and the chamfered portion 1*n* are set.

In detail, as illustrated in FIG. 10, the sectional area of the space formed between the chamfered portion 1*m* and the chamfered portion 2*n* under the state in which the chamfered portion 1*m* and the chamfered portion 2*n* are arranged closest to each other is defined as Av1. That is, the area surrounded by the chamfered portion 1*m*, the chamfered portion 2*n*, and the imaginary straight lines connecting ends of the chamfered portion 1*m* and ends of the chamfered portion 2*n* is defined as Av1. Further, as illustrated in FIG. 11, the sectional area of the space formed between the chamfered portion 2*m* and the chamfered portion 1*n* under the state in which the chamfered portion 2*m* and the chamfered portion 1*n* are arranged closest to each other is defined as Av2. That is, the area surrounded by the chamfered portion 2*m*, the chamfered portion 1*n*, and the imaginary straight lines connecting ends of the chamfered portion 2*m* and ends of the chamfered portion 1*n* is defined as Av2. Further, as illustrated in FIG. 9, the sectional area of the compression chamber 1*f*, that is, the largest sectional area of the compression chamber 1*f* in the cross section that passes through the orbiting center of the orbiting scroll 2 and is taken along the standing direction of the spiral blade 1*b* of the fixed scroll 1 and the spiral blade 2*b* of the orbiting scroll 2 is defined as Ac. Similarly to Embodiment 1, when Av1, Av2, and Ac are defined as described above, the scroll compressor 100 of Embodiment 2 has a configuration satisfying the following expression.

$$0<\{(Av1+Av2)/2\}/Ac<1\times10^{-4}$$

In Embodiment 2, the chamfered portion 1*m* and the chamfered portion 2*m* are formed to have an equal size (chamfer dimension), and the chamfered portion 1*n* and the chamfered portion 2*n* are formed to have an equal size (chamfer dimension). That is, in Embodiment 2, the expression of Av1=Av2=Av is satisfied. Consequently, the above-mentioned expression can also be expressed with the following expression.

$$0<Av/Ac<1\times10^{-4}$$

As described above, also in the scroll compressor 100 of Embodiment 2, similarly to Embodiment 1, the chamfered portion 1*m* is formed at the distal end portion 1*h* of the spiral blade 1*b* of the fixed scroll 1, and the chamfered portion 2*n* having the same shape as that of the chamfered portion 1*m* is formed in the bottom portion 2*k* of the spiral blade 2*b* of the orbiting scroll 2. Further, the chamfered portion 2*m* is formed at the distal end portion 2*h* of the spiral blade 2*b* of the orbiting scroll 2, and the chamfered portion 1*n* having the same shape as that of the chamfered portion 2*m* is formed in the bottom portion 1*k* of the spiral blade 1*b* of the fixed scroll 1. Further, the configuration satisfying the expression of $0<Av/Ac<1\times10^{-4}$ is satisfied. Consequently, also with the scroll compressor 100 of Embodiment 2, similarly to Embodiment 1, leakage of the refrigerant gas that is being compressed from the gap between the distal end portion and the bottom portion of the spiral blades can be prevented, thereby preventing the increase in leakage loss.

Thus, with the scroll compressor 100 of Embodiment 2, similarly to Embodiment 1, a highly efficient scroll compressor can be achieved.

Embodiment 3

In Embodiment 1, when the chamfered portion 1*m* and the chamfered portion 2*m* each having a straight chamfer shape are formed, the chamfer dimension C1*m* (see FIG. 3) of the chamfered portion 1*m* and the chamfer dimension C2*m* (see FIG. 4) of the chamfered portion 2*m* are set to be equal to each other. However, the chamfer dimension C1*m* and the chamfer dimension C2*m* may be different from one another. As long as the chamfered portion 1*m* and the chamfered portion 2*n* have the same shape, and the chamfered portion 2*m* and the chamfered portion 1*n* have the same shape, the effect described in Embodiment 1 can be obtained. In Embodiment 3, matters that are not particularly described are the same as those of Embodiment 1, and the same function and configuration are described with the same reference signs.

In the scroll compressor 100 of Embodiment 3, at each of both the corner portions of the distal end portion 1*h* of the spiral blade 1*b* of the fixed scroll 1, there is formed the chamfered portion 1*m* having a straight chamfer shape in cross section. On each of both the sides of the bottom portion 2*k* of the spiral blade 2*b* of the orbiting scroll 2, there is formed the chamfered portion 2*n* having the same shape as that of the chamfered portion 1*m*. That is, the chamfered portion 2*n* formed at the bottom portion 2*k* of the spiral blade 2*b* of the orbiting scroll 2 is shaped to be along the chamfered portion 1*m* when the chamfered portion 1*m* formed at the distal end portion 1*h* of the spiral blade 1*b* of the fixed scroll 1 is brought close to the chamfered portion 2*n*.

Further, at each of both the corner portions of the distal end portion 2*h* of the spiral blade 2*b* of the orbiting scroll 2, there is formed the chamfered portion 2*m* having a straight chamfer shape in cross section. On each of both the sides of the bottom portion 1*k* of the spiral blade 1*b* of the fixed scroll 1, there is formed the chamfered portion 1*n* having the same shape as that of the chamfered portion 2*m*. That is, the chamfered portion 1*n* formed at the bottom portion 1*k* of the spiral blade 1*b* of the fixed scroll 1 is shaped to be along the chamfered portion 2*m* when the chamfered portion 2*m* formed at the distal end portion 2*h* of the spiral blade 2*b* of the orbiting scroll 2 is brought close to the chamfered portion 1*n*.

In the scroll compressor 100 of Embodiment 3, the chamfer dimension C1*m* (see FIG. 3) of the chamfered portion 1*m* and the chamfer dimension C2*m* (see FIG. 4) of the chamfered portion 2*m* are different from one another. Further, in the scroll compressor 100 of Embodiment 3, the chamfer dimension C2*n* (see FIG. 3) of the chamfered portion 2*n* and the chamfer dimension C1*n* (see FIG. 4) of the chamfered portion 1*n* are different from one another.

That is, the following relationships are satisfied.

$$C1m \neq C2m$$

$$C1n \neq C2n$$

Even when the scroll compressor 100 has such a configuration, the chamfered portion 1*m* and the chamfered portion 2*n* can have the same shape, and the chamfered portion 2*m* and the chamfered portion 1*n* can have the same shape. Thus, the configuration satisfying the expression of $0<\{(Av1+Av2)/2\}/Ac<1\times10^{-4}$ can be achieved. Consequently, also with the scroll compressor 100 of Embodiment 3, similarly to Embodiment 1, the leakage of the refrigerant gas that is being compressed from the distal end portion and the bottom portion of the spiral blades can be prevented. Consequently, the increase in leakage loss can be prevented. Thus, also with the scroll compressor 100 of Embodiment 3, similarly to Embodiment 1, a highly efficient scroll compressor can be achieved.

Further, with the configuration of the chamfered portion 1*m*, the chamfered portion 1*n*, the chamfered portion 2*m*, and the chamfered portion 2*n* as in Embodiment 3, the following effect can be obtained.

The spiral blade 1*b* of the fixed scroll 1 is formed by grinding off, through use of a processing cutter such as an end mill, a periphery of the spiral blade 1*b* from a material to be formed into the fixed scroll 1. At this time, a chamfer having the same shape as that of the chamfered portion 1*n*, which is to be formed at the bottom portion 1*k* of the fixed scroll 1, is formed at a distal end of the processing cutter, that is, a chamfer having the chamfer dimension C1*n* is formed at a distal end of the processing cutter. Consequently, the chamfered portion 1*n* can be formed at the bottom portion 1*k* of the fixed scroll 1. Similarly, the spiral blade 2*b* of the orbiting scroll 2 is also formed by grinding off, through use of the processing cutter such as an end mill, a periphery of the spiral blade 2*b* from a material to be formed into the spiral blade 2*b*. At this time, a chamfer having the same shape as that of the chamfered portion 2*n*, which is to be formed at the bottom portion 2*k* of the orbiting scroll 2, is formed at a distal end of the processing cutter, that is, a chamfer having the chamfer dimension C2*n* is formed at a distal end of the processing cutter. Consequently, the chamfered portion 2*n* can be formed at the bottom portion 2*k* of the orbiting scroll 2. The processing cutter for grinding off the spiral blade 1*b* of the fixed scroll 1 and the spiral blade 2*b* of the orbiting scroll 2 is abraded earlier at the distal end portion and shorter in life time as the tool as the hardness of the material to be subjected to processing is higher and as the chamfer dimension of the distal end portion is smaller.

Herein, there is a case where a material of the fixed scroll 1 and a material of the orbiting scroll 2 are different from each other. For example, the material of the fixed scroll 1 is cast iron, and the material of the orbiting scroll 2 is aluminum or aluminum alloy. In such a case, it is preferred that a chamfer dimension of one of the chamfered portion 1*n* and the chamfered portion 2*n* higher in hardness be set larger and that a chamfer dimension of the other one lower in hardness be set smaller. That is, it is preferred that the chamfer dimension C1*n* of the chamfered portion 1*n* formed in the fixed scroll 1 having higher hardness be set larger and that the chamfer dimension C2*n* of the chamfered portion 2*n* formed in the orbiting scroll 2 having lower hardness be set smaller. Further, depending on the chamfer dimensions of the chamfered portion 1*n* and the chamfered portion 2*n*, the chamfer dimension C1*m* of the chamfered portion 1*m* formed in the fixed scroll 1 may be set smaller, and the chamfer dimension C2*m* of the chamfered portion 2*m* formed in the orbiting scroll 2 may be set larger.

That is, it is preferred that the following conditions be satisfied.

$$C1n > C2n$$

$$C1m < C2m$$

With such a configuration, the sectional area Av1 of the gap between the chamfered portion 1*m* formed in the distal end portion 1*h* of the spiral blade 1*b* of the fixed scroll 1 and the chamfered portion 2*n* formed in the bottom portion 2*k* of the spiral blade 2*b* of the orbiting scroll 2 is set smaller than that of Embodiment 1. Further, the sectional area Av2 of the gap formed between the chamfered portion 2*m* formed in the distal end portion 2*h* of the spiral blade 2*b* of the orbiting scroll 2 and the chamfered portion 1*n* formed in the bottom portion 1*k* of the spiral blade 1*b* of the fixed scroll 1 is set larger than that of Embodiment 1.

That is, the following condition is satisfied.

$$Av1<Av2$$

With the configuration of the scroll compressor 100 described above, abrasion at the distal end of the processing cutter for grinding off the spiral blade 1*b* of the fixed scroll 1, that is, abrasion at the distal end of the processing cutter whose distal end portion is abraded early and that is more liable to be short in tool life time can be prevented. Consequently, the tool life time of the processing cutter can be increased. As the tool life time of the processing cutter can be increased, the spiral blade 1*b* of the fixed scroll 1 can be processed with high accuracy.

Embodiment 4

In Embodiment 2, when the chamfered portion 1*m* and the chamfered portion 2*m* each having an arcuate chamfer shape are formed, a chamfer dimension (arcuate radius) R1*m* (see FIG. 10) of the chamfered portion 1*m* and a chamfer dimension (arcuate radius) R2*m* (see FIG. 11) of the chamfered portion 2*m* are set to be equal to each other. However, the chamfer dimension R1*m* and the chamfer dimension R2*m* may be different from one another. As long as the chamfered portion 1*m* and the chamfered portion 2*n* have the same shape, and the chamfered portion 2*m* and the chamfered portion 1*n* have the same shape, the effect described in Embodiment 2 can be obtained. In Embodiment 4, matters that are not particularly described are the same as those of Embodiment 2, and the same function and configuration are described with the same reference signs.

In the scroll compressor 100 of Embodiment 4, at each of both the corner portions of the distal end portion 1*h* of the spiral blade 1*b* of the fixed scroll 1, there is formed the chamfered portion 1*m* having an arcuate chamfer shape in cross section. On each of both the sides of the bottom portion 2*k* of the spiral blade 2*b* of the orbiting scroll 2, there is formed the chamfered portion 2*n* having the same shape as that of the chamfered portion 1*m*. That is, the chamfered portion 2*n* formed at the bottom portion 2*k* of the spiral blade 2*b* of the orbiting scroll 2 is shaped to be along the chamfered portion 1*m* when the chamfered portion 1*m* formed at the distal end portion 1*h* of the spiral blade 1*b* of the fixed scroll 1 is brought close to the chamfered portion 2*n*.

Further, at each of both the corner portions of the distal end portion 2*h* of the spiral blade 2*b* of the orbiting scroll 2, there is formed the chamfered portion 2*m* having an arcuate chamfer shape in cross section. On each of both the sides of the bottom portion 1*k* of the spiral blade 1*b* of the fixed scroll 1, there is formed the chamfered portion 1*n* having the same shape as that of the chamfered portion 2*m*. That is, the chamfered portion 1*n* formed at the bottom portion 1*k* of the spiral blade 1*b* of the fixed scroll 1 is shaped to be along the chamfered portion 2*m* when the chamfered portion 2*m* formed at the distal end portion 2*h* of the spiral blade 2*b* of the orbiting scroll 2 is brought close to the chamfered portion 1*n*.

Herein, in the scroll compressor 100 of Embodiment 4, the chamfer dimension R1*m* (see FIG. 10) of the chamfered portion 1*m* and the chamfer dimension R2*m* (see FIG. 11) of the chamfered portion 2*m* are different from one another. Further, in the scroll compressor 100 of Embodiment 4, a chamfer dimension (arcuate radius) R2*n* (see FIG. 10) of the chamfered portion 2*n* and a chamfer dimension (arcuate radius) R1*n* (see FIG. 11) of the chamfered portion 1*n* are different from one another. That is, the following relationships are satisfied.

$$R1m \neq R2m$$

$$R1n \neq R2n$$

Even when the scroll compressor 100 has such a configuration, the chamfered portion 1*m* and the chamfered portion 2*n* can have the same shape, and the chamfered portion 2*m* and the chamfered portion 1*n* can have the same shape. Thus, the configuration satisfying the expression of $0<\{(Av1+Av2)/2\}/Ac<1\times10^{-4}$ can be achieved. Consequently, also with the scroll compressor 100 of Embodiment 4, similarly to Embodiment 2, the leakage of the refrigerant gas that is being compressed from the distal end portion and the bottom portion of the spiral blades can be prevented. Consequently, the increase in leakage loss can be prevented. Thus, also with the scroll compressor 100 of Embodiment 4, similarly to Embodiment 2, a highly efficient scroll compressor can be achieved.

Further, with the configuration of the chamfered portion 1*m*, the chamfered portion 1*n*, the chamfered portion 2*m*, and the chamfered portion 2*n* as in Embodiment 4, the following effect can be obtained.

The spiral blade 1*b* of the fixed scroll 1 is formed by grinding off, through use of the processing cutter such as an end mill, the periphery of the spiral blade 1*b* from the material to be formed into the fixed scroll 1. At this time, the chamfer having the same shape as that of the chamfered portion 1*n*, which is to be formed at the bottom portion 1*k* of the fixed scroll 1, is formed at the distal end of the processing cutter, that is, the chamfer having the chamfer dimension R1*n* is formed at the distal end of the processing cutter. Consequently, the chamfered portion 1*n* can be formed at the bottom portion 1*k* of the fixed scroll 1. Similarly, the spiral blade 2*b* of the orbiting scroll 2 is also formed by grinding off, through use of the processing cutter such as an end mill, the periphery of the spiral blade 2*b* from the material to be formed into the spiral blade 2*b*. At this time, the chamfer having the same shape as that of the chamfered portion 2*n*, which is to be formed at the bottom portion 2*k* of the orbiting scroll 2, is formed at the distal end of the processing cutter, that is, the chamfer having the chamfer dimension R2*n* is formed at the distal end of the processing cutter. Consequently, the chamfered portion 2*n* can be formed at the bottom portion 2*k* of the orbiting scroll 2. The processing cutter for grinding off the spiral blade 1*b* of the fixed scroll 1 and the spiral blade 2*b* of the orbiting scroll 2 is abraded earlier at the distal end portion and shorter in life time as the tool as the hardness of the material to be subjected to processing is higher and as the chamfer dimension of the distal end portion is smaller.

Herein, there is the case where the material of the fixed scroll 1 and the material of the orbiting scroll 2 are different from each other. For example, the material of the fixed scroll 1 is cast iron, and the material of the orbiting scroll 2 is aluminum or aluminum alloy. In such a case, it is preferred that a chamfer dimension of one of the chamfered portion 1*n* and the chamfered portion 2*n* higher in hardness be set larger and that a chamfer dimension of the other one lower in hardness be set smaller. That is, it is preferred that the chamfer dimension R1*n* of the chamfered portion 1*n* formed in the fixed scroll 1 having higher hardness be set larger and that the chamfer dimension R2*n* of the chamfered portion 2*n* formed in the orbiting scroll 2 having lower hardness be set smaller. Further, depending on the chamfer dimensions of the chamfered portion 1*n* and the chamfered portion 2*n*, the chamfer dimension R1*m* of the chamfered portion 1*m* formed in the fixed scroll 1 may be set smaller, and the chamfer dimension R2*m* of the chamfered portion 2*m* formed in the orbiting scroll 2 may be set larger.

That is, it is preferred that the following conditions be satisfied.

$$R1n>R2n$$

$$R1m<R2m$$

With such a configuration, the sectional area Av1 of the gap between the chamfered portion 1*m* formed in the distal end portion 1*h* of the spiral blade 1*b* of the fixed scroll 1 and the chamfered portion 2*n* formed in the bottom portion 2*k* of the spiral blade 2*b* of the orbiting scroll 2 is set smaller than that of Embodiment 2. Further, the sectional area Av2 of the gap formed between the chamfered portion 2*m* formed in the distal end portion 2*h* of the spiral blade 2*b* of the orbiting scroll 2 and the chamfered portion 1*n* formed in the bottom portion 1*k* of the spiral blade 1*b* of the fixed scroll 1 is set larger than that of Embodiment 2.

That is, the following condition is satisfied.

$$Av1<Av2$$

With the configuration of the scroll compressor 100 described above, the abrasion at the distal end of the processing cutter for grinding off the spiral blade 1*b* of the fixed scroll 1, that is, the abrasion at the distal end of the processing cutter whose distal end portion is abraded early and that is more liable to be short in tool life time can be prevented. Consequently, the tool life time of the processing cutter can be increased. As the tool life time of the processing cutter can be increased, the spiral blade 1*b* of the fixed scroll 1 can processed with high accuracy.

REFERENCE SIGNS LIST

1 fixed scroll 1*a* base plate portion 1*b* spiral blade 1*c* Oldham guide groove 1*d* discharge port 1*e* suction port 1*f* compression chamber

1*h* distal end portion 1*k* bottom portion 1*m* chamfered portion 1*n* chamfered portion 2 orbiting scroll 2*a* base plate portion 2*b* spiral blade 2*c* Oldham guide groove 2*d* orbiting bearing 2*e* gas extraction hole 2*f* thrust surface 2*g* boss portion outer space 2*h* distal end portion 2*k* bottom portion 2*m* chamfered portion 2*n* chamfered portion 2*o* base plate outer peripheral space 3 compliant frame 3*a* thrust bearing 3*b* surface 3*c* main bearing 3*d* auxiliary main bearing 3*e* communication hole 3*f* communication hole 3*g* intermediate pressure adjustment valve 3*h* intermediate pressure adjustment valve pressing member 3*k* intermediate pressure adjustment spring 3*m* communication hole 3*n* intermediate pressure adjustment valve storage space 3*p* upper cylindrical surface 3*s* lower cylindrical surface 3*t* thrust bearing opening portion 3*v* lower end surface 4 guide frame 4*a* frame upper space 4*b* frame lower space 4*c* upper cylindrical surface 4*d* lower cylindrical surface 4*f* first passage 4*g* first discharge passage 5 electric motor 5*a* rotor 5*b* stator 5*f* penetrating flow passage 5*g* second passage 5*h* lead line 6 main shaft 6*a* orbiting shaft portion 6*b* main shaft portion 6*c* sub shaft portion 6*d* oil feeding port 6*e* high-pressure oil feeding hole 6*f* main shaft balance weight 6*g* oil feeding hole 7*a* ring-shaped sealing member 7*b* ring-shaped sealing member 8 sub frame 8*a* sub bearing 9 Oldham mechanism 9*a* fixed-side key 9*b* orbiting-side key 9*c* Oldham mechanism annular portion

10 hermetic container 10*a* high-pressure space 10*b* glass terminal

11 refrigerating machine oil 12 discharge pipe 13 suction pipe 14 compression mechanism 15*a* first balance weight 15*b* second balance weight

100 scroll compressor 201 fixed scroll (related art) 201*b* spiral blade (related art) 201*h* distal end portion (related art) 201*k* bottom portion (related art)

201*m* chamfered portion (related art) 201*n* chamfered portion (related art) 202 orbiting scroll (related art) 202*b* spiral blade (related art) 202*h* distal end portion (related art) 202*k* bottom portion (related art) 202*m* chamfered portion (related art) 202*n* chamfered portion (related art)

The invention claimed is:

1. A scroll compressor, comprising:

a fixed scroll including a first base plate portion and a first spiral blade provided to stand on one surface of the first base plate portion;

an orbiting scroll including a second base plate portion and a second spiral blade provided to stand on a surface of the second base plate portion opposite to the fixed scroll, and is configured to perform an orbiting motion with respect to the fixed scroll, the first spiral blade and the second spiral blade being in mesh with each other to form a compression chamber;

a first chamfered portion formed at each of both corner portions of a distal end portion of the first spiral blade;

a second chamfered portion formed at each of both corner portions of a distal end portion of the second spiral blade;

a third chamfered portion formed on each of both sides of a bottom portion of the first spiral blade, the third chamfered portion having a same shape as a shape of the second chamfered portion; and a fourth chamfered portion formed on each of both sides of a bottom portion of the second spiral blade, the fourth chamfered portion having a same shape as a shape of the first chamfered portion, a chamfer dimension of the first chamfered portion and a chamfer dimension of the second chamfered portion being different from each other.

2. The scroll compressor of claim 1, wherein each of the first chamfered portion, the second chamfered portion, the third chamfered portion, and the fourth chamfered portion has a straight chamfer shape in cross section.

3. The scroll compressor of claim 1, wherein each of the first chamfered portion, the second chamfered portion, the third chamfered portion, and the fourth chamfered portion has an arcuate chamfer shape in cross section.

4. The scroll compressor of claim 1, wherein the fixed scroll and the orbiting scroll are made of materials having different hardness, and wherein a chamfer dimension of one of the third chamfered portion and the fourth chamfered portion having higher hardness is larger in comparison to a chamfer dimension of one of the third chamfered portion and the fourth chamfered portion having lower hardness.

5. The scroll compressor of claim 1, wherein an expression of $0<\{(Av\mathbf{1}+Av\mathbf{2})/2\}/Ac<1\times10^4$ is satisfied, under a state in which, among cross sections of the compression chamber passing through an orbiting center of the orbiting scroll and along a standing direction of the first spiral blade and the second spiral blade, a cross section having a largest sectional area is observed, where a sectional area of a space formed between the first chamfered portion and the fourth chamfered portion under a state in which the first chamfered portion and the fourth chamfered portion are closest to each other is defined as Av1, a sectional area of a space formed between the second chamfered portion and the third chamfered portion under a state in which the second chamfered portion and the third chamfered portion are closest to each other is defined as Av2, and a sectional area of the compression chamber is defined as Ac.

6. The scroll compressor of claim 1, wherein the chamfer dimension of the first chamfer portion is a size of the first chamfer portion, and the chamfer dimension of the second chamfer portion is a size of the second chamfer portion.

* * * * *